United States Patent [19]

Lilley

[11] 4,133,515

[45] Jan. 9, 1979

[54] HEAT TREATMENT

[75] Inventor: Brian C. Lilley, Runcorn, England

[73] Assignee: Imperial Chemical Industries Limited, London, England

[21] Appl. No.: 840,215

[22] Filed: Oct. 7, 1977

[30] Foreign Application Priority Data

Oct. 12, 1976 [GB] United Kingdom ..... 42316/76

[51] Int. Cl.[2] ..... C21D 1/44

[52] U.S. Cl. ..... 266/120; 266/159

[58] Field of Search ..... 266/120, 144, 158, 159, 266/200, 242; 98/115 R, 115 VM, 115 LH; 432/64

[56] References Cited

U.S. PATENT DOCUMENTS 2,116,069 5/1938 Hoffman et al. ..... 266/120

*Primary Examiner*—Gerald A. Dost

*Attorney, Agent, or Firm*—Cushman, Darby & Cushman

[57] ABSTRACT

A heat treatment plant comprising an assembly of refractory material adapted to receive a bath and containing a channel for a burner and optionally a channel for a flue, a framework adjacent to the refractory material, and at least one sub-frame mounted on the framework and adapted to receive a burner and flue. The burner and flue being capable of traversing the sub-frame in a direction transverse to that in which the sub-frame may traverse the framework.

11 Claims, 3 Drawing Figures

Figure 3:
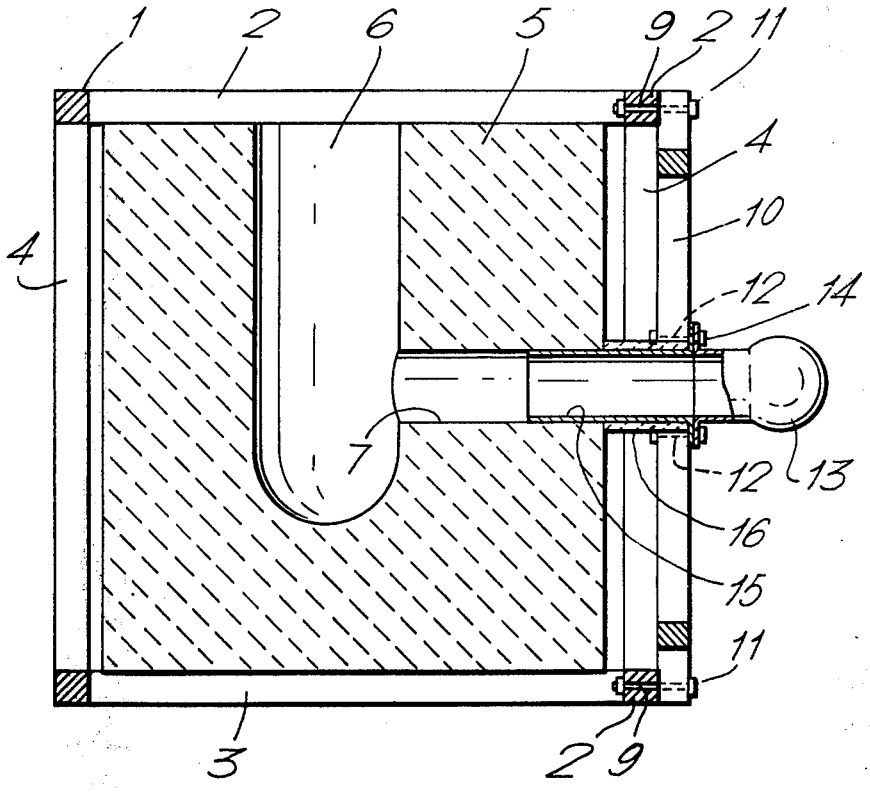

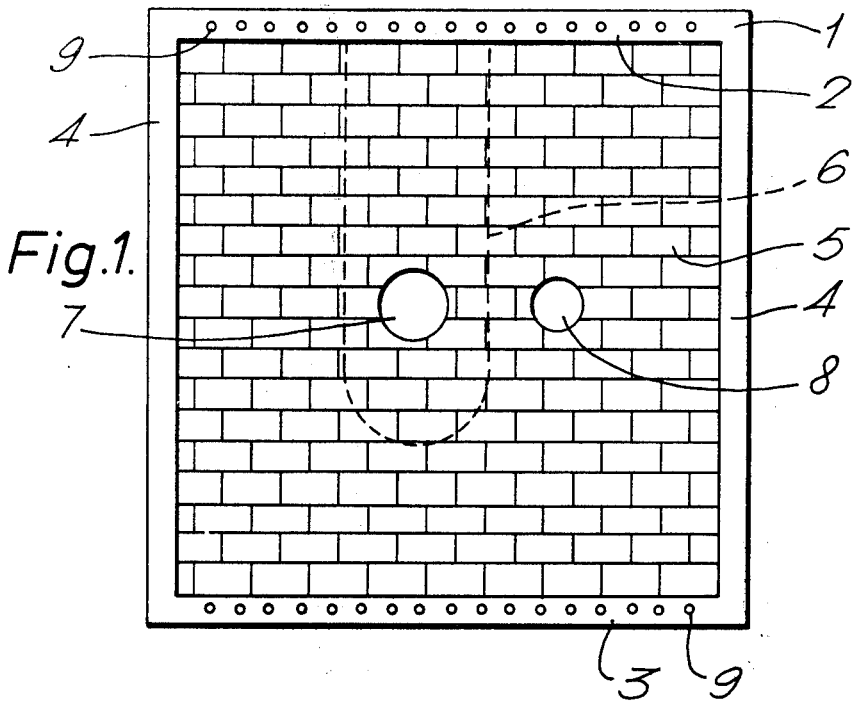
Fig.1.
Fig.2.
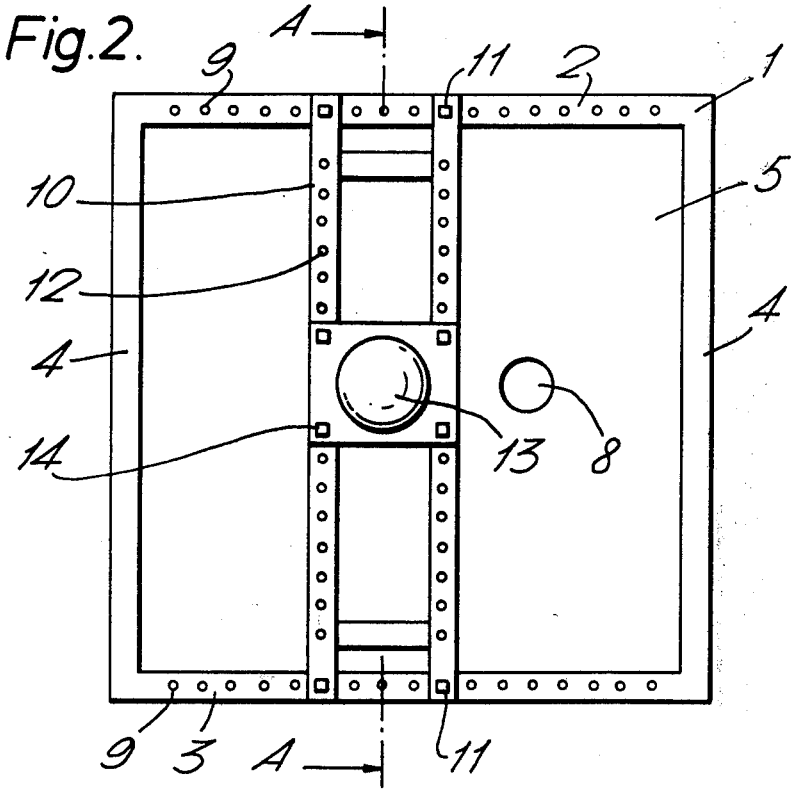

HEAT TREATMENT

This invention relates to plant for the treatment of metals, especially for the heat treatment of metals, and in particular it relates to molten salt bath heat treatment plant.

Various metal heat treatment processes are known. For example, it is known to improve the surface properties of metal articles, especially articles of iron or of ferrous alloys, by treating the articles in a bath of molten salt. Such known treatments include carburising and nitriding of metal parts, for example, by heating the parts in a molten salt bath containing an alkali metal cyanide. Other known processes include heating metal articles in molten salt baths in order to bring about phase changes in the articles treated; treating metal articles in molten salt baths, for example, in a salt bath containing a mixture of an alkali metal nitrate and an alkali metal nitrite, in order to clean the articles, for example, in order to remove paint from the articles or to remove sand from metal castings; and treating articles in aqueous media, e.g. in solutions of salts at high temperature, in order to wash the articles.

The plant in which such heat treatment processes may be carried out generally comprises a bath for containing the molten salt or aqueous medium surrounded by an assembly of refractory material, for example an assembly of refractory brickwork, or of refractory inorganic fibrous material capable of withstanding a high temperature, positioned within an outer framework, and means for heating the bath. Within the assembly of refractory material there may be a channel leading from an outer wall of the refractory material to the wall of the bath. The channel is adapted to receive the means for heating the bath, which may be, for example, a gas burner or an oil burner, and to transfer the hot gases produced by the burner to the wall of the bath. When the heating involves combustion of a fuel, as in a gas or oil burner, there may also be included in the assembly of refractory material a channel through which the gaseous products of combustion may be removed. Such plant may also include sheet metal facing enclosing and protecting the refractory material and a sheet metal top having an aperture corresponding in position to the cavity in the assembly of refractory material in which the bath is placed.

Where the assembly of refractory material contains a channel adapted to receive a heater, hereinafter referred to as a burner, and where necessary a channel through which combustion gases may be removed, the sheet metal facing must include apertures in register with the channels in the refractory material. It is also necessary to provide support for the burner, and the burner is generally mounted on and supported by the sheet metal facing and positioned through one of the apertures in the metal facing and into the appropriate channel in the refractory material, and where necessary a flue is positioned over the other of the apertures and fastened to the sheet metal facing so that the combustion gases may be removed from the plant.

It is sometimes necessary to change the size and/or the shape of the bath in which the metal articles are treated, for example, in order to accommodate in the bath a metal part or parts of different shape. As a consequence of changing the bath at least part of the refractory material may have to be changed, and in particular it may be necessary to change the position of the channel which is adapted to receive the burner and/or of the channel through which the combustion gases are removed. As a consequence of any such change the apertures in the sheet metal facing which receive the burner and the flue through which combustion gases may be removed must be changed. The need to change the positions of these latter apertures is inconvenient and results in added expense as it necessitates providing a completely new sheet metal facing with the apertures in the required new positions. Thus, the plant manufacturer needs to stock a number of sheet metal facings having apertures in different positions.

We have now found that it is possible to provide a convenient means of supporting and positioning the burner, and if necessary the flue for removing combustion gases, which does not require the provision of a sheet metal facing and by means of which the burner and flue may readily be located at a plurality of positions corresponding with the plurality of positions of the channels in the assembly of refractory material.

The present invention provides a heat treatment plant comprising an assembly of refractory material adapted to receive a bath in which metal articles may be heat treated and having a channel suitable for receiving a burner, and optionally a channel suitable for removal of combustion gases, a framework adjacent that part of the assembly of refractory material containing the channel(s), and at least one sub-frame mounted on said framework and adapted to receive a burner and optionally a flue for removal of combustion gases, the sub-frame(s) being capable of traversing the framework, and the burner and flue, when mounted on the sub-frame(s), being capable of traversing the sub-frame(s) in a direction which is transverse to the direction in which the sub-frame(s) traverses the framework.

It can be seen that because the burner and flue, when mounted on the sub-frame(s), can traverse the sub-frame(s) in a direction transverse to that in which the sub-frame(s) transverses the framework, the burner and flue may readily be positioned in a plurality of positions corresponding to the positions of the channels in the assembly of refractory material.

In general the refractory material will be an assembly of refractory bricks of box-like shape, or an assembly of refractory inorganic fibrous material, having a cavity in the top to receive the bath which may be of steel or other metal, e.g. titanium or titanium-lined steel, and leading into the bricks from one face thereof will be a channel suitable for receiving a burner and optionally a channel suitable for receiving a flue for the combustion gases. The channels will communicate with the cavity in which the bath is placed. The framework will generally be of square or oblong shape and be of dimensions substantially the same or slightly greater than those of the face of the assembly of refractory bricks containing the apertures of the channels.

The plant of the present invention may contain one subframe only, in which case the sub-frame should be capable of receiving both the burner and, when present, the flue for combustion gases, or it may comprise more than one sub-frame, e.g. two sub-frames, one of which is capable of receiving the burner and another of which is capable of receiving the flue for combustion gases. The specification will hereinafter refer to the sub-frame although it is to be understood that the plant may comprise more than one sub-frame.

In a preferred embodiment the sub-frame may be mounted on the framework in such a way as to be capable of traversing the framework in a horizontal direction. In this case, and where the framework is square or oblong-shape and comprises horizontal top and bottom members and vertical side members, the sub-frame will be mounted on and between the top and bottom members and the burner and optionally the flue, when mounted on the sub-frame, will be capable of moving vertically on the sub-frame. Alternatively, the sub-frame may be mounted on the framework in such a way as to be capable of traversing the framework in a vertical direction. In this case, and where the framework is square or oblong-shaped and comprises horizontal top and bottom members and vertical side members, the sub-frame will be mounted on and between the side members of the framework and the burner and optionally the flue, when mounted on the sub-frame, will be capable of moving horizontally on the sub-frame.

The framework may, for example, be made of steel and may be constructed, for example of angle iron sections or of square sections, e.g. hollow square sections. The framework on which the sub-frame is mounted may itself form part of a larger framework. Thus, when the refractory material is an assembly of refractory brick of generally box-like shape the assembly may be positioned within a framework of dimensions substantially the same as or larger than those of the assembly of refractory bricks. The sub-frame may be mounted on the framework adjacent to one of the vertical faces of the assembly of refractory bricks, and on the framework adjacent to the remaining vertical faces of brick sheet metal plate may be mounted. The top of the framework may carry a sheet metal plate containing an aperture corresponding to the cavity in the assembly of refractory bricks which receives the bath in which the metal articles are treated.

The sub-frame may consist of, for example, a plate having an aperture to receive a burner and/or a flue for exhaust gases. Where the framework is square or oblong-shaped and the plate sub-frame is mounted between the top and bottom members of the framework or between the side members of the framework then in order to permit movement of the sub-frame on the framework the horizontal dimensions of the plate sub-frame, or the vertical dimensions of the plate sub-frame, as the case may be, will be substantially less than the distance between the side members of the framework, or between the top and bottom members of the framework, as the case may be.

Alternatively, the sub-frame may consist of, for example, a plurality of rigidly interconnected bars mounted on the framework.

The framework may suitably include a channel in which the sub-frame is mounted and in which the sub-frame travels in traversing the framework. Alternatively, the sub-frame may itself provide the channel.

Although the sub-frame is mounted on and traverses the framework it is clearly desirable that it is capable of being fixed to the framework in order that the position of the sub-frame may be fixed relative to the positions of the apertures of the channels in the assembly of refractory material. The sub-frame may be fixed in position on the framework by bolting the sub-frame to the framework. Thus, the framework and the sub-frame may comprise a plurality of holes to receive bolts. Alternatively, the sub-frame may be clipped to the framework in which case very fine adjustment of the position of the sub-frame on the framework, and finer adjustment than is the case where bolts are used, is permitted, as location of the sub-frame on the framework does not require holes in the sub-frame to be positioned in register with holes in the framework. Similar means may be used to fix the position of the burner and flue on the sub-frame(s).

An embodiment of the invention is now described with reference to the following diagrams in which FIG. 1 is a rear view in elevation of the framework and associated refractory brickwork of a heat treatment plant, FIG. 2 is a rear view in elevation similar to that shown in FIG. 1 with a sub-frame in position on the framework, and FIG. 3 is a side view of a heat treatment plant in cross-section along the line A—A of FIG. 2.

The plant comprises a framework of generally box-like shape (1) having horizontal top members (2), horizontal bottom members (3), and vertical side members (4), and an assembly of brickwork (5) positioned within the space defined by the framework (1). (In FIG. 1 details of the brickwork (5) are shown whereas for the sake of clarity details of this brickwork have been omitted from FIGS. 2 and 3.) In the assembly of refractory brickwork there is a cavity (6) designed to receive a bath (not shown) in which metal articles are treated, a channel (7) suitable for receiving a burner for heating the bath, and a channel (8) suitable for receiving a flue (not shown) for removal of combustion gases. The top and bottom members of the framework adjacent to that part of the assembly of refractory bricks containing the openings of the channels (7, 8) include a plurality of holes (9), and a sub-frame (10) is attached to the top and bottom members of the framework by means of bolts (11). In the view shown in FIG. 1 the sub-frame (10) has been omitted for the sake of clarity. The sub-frame includes a plurality of holes (12). A burner (13) (shown diagrammatically) is attached to the sub-frame by means of bolts (14).

The burner (13) includes a connecting piece (15) which is also clamped to the sub-frame (10), and around the connecting piece (15) and between the brickwork (5) and the sub-frame (10) there is positioned a collar of refractory material (16).

Although it is not shown in the accompanying figures the framework (1) may carry a second sub-frame which sub-frame itself carries a flue for positioning in the channel (8) so that combustion gases may safely be removed.

In operation a bath is positioned in the cavity (6), a salt mixture is charged to the bath, the burner (13), is positioned adjacent to the channel (7) with the connecting piece (15) in the channel (7), and a flue (not shown) is positioned in the channel (8). The salt mixture in the bath is heated by means of the burner (13) and when the resultant molten salt bath is at the required temperature metal parts are treated by immersing them in the molten salt bath.

Should it be necessary to change the position of the cavity (6) in the assembly of refractory brickwork, and in consequence change the position of the channel (7), then the position of the burner (13) may be changed so that it is adjacent to the newly-positioned channel (7) merely by moving the sub-frame (10) horizontally on the framework (1) and the burner (13) vertically on the sub-frame (10) By similar means a flue (not shown) may be positioned adjacent to any desired position of the channel (8).

I claim:

1. A heat treatment plant comprising an assembly of refractory material adapted to receive a bath in which metal articles may be heat treated and having a channel suitable for receiving a burner, a framework adjacent that part of the assembly of refractory material containing the channel, and at least one sub-frame mounted on said framework and adapted to receive the burner, the sub-frame being capable of traversing the framework, and the burner, when mounted on the sub-frame, being capable of traversing the sub-frame in a direction which is transverse to the direction in which the sub-frame traverses the framework.

2. A heat treatment plant as claimed in claim 1 in which the assembly of refractory material has a channel suitable for removal of combustion gases and in which the sub-frame is adapted to receive a flue for combustion gases.

3. A heat treatment plant as claimed in claim 2 which comprises two sub-frames, one sub-frame being adapted to receive a burner and one sub-frame being adapted to receive a flue.

4. A heat treatment plant as claimed in claim 1 in which the framework is of square shape.

5. A heat treatment plant as claimed in claim 4 in which the framework comprises horizontal top and bottom members and vertical side members.

6. A heat treatment plant as claimed in claim 5 in which the sub-frame is mounted on and between the top and bottom members of the framework and is capable of traversing the framework in a horizontal direction.

7. A heat treatment plant as claimed in claim 5 in which the sub-frame is mounted on and between the side members of the framework and is capable of traversing the framework in a vertical direction.

8. A heat treatment plant as claimed in claim 1 in which the framework is of oblong shape.

9. A heat treatment plant as claimed in claim 8 in which the framework comprises horizontal top and bottom members and vertical side members.

10. A heat treatment plant as claimed in claim 9 in which the sub-frame is mounted on and between the top and bottom members of the framework and is capable of traversing the framework in a horizontal direction.

11. A heat treatment plant as claimed in claim 9 in which the sub-frame is mounted on and between the side members of the framework and is capable of traversing the framework in a vertical direction.

* * * * *